US005350081A

United States Patent [19]

Graham

[11] Patent Number: 5,350,081

[45] Date of Patent: Sep. 27, 1994

[54] BEVERAGE CONTAINER HOLDER

[76] Inventor: Wayne B. Graham, 4475 Golden Foothill Pkwy., El Dorado Hills, Calif. 95762

[21] Appl. No.: 136,302

[22] Filed: Oct. 13, 1993

[51] Int. Cl.[5] ..... B65D 21/00

[52] U.S. Cl. ..... 220/737; 220/23.83

[58] Field of Search ..... 220/737, 739, 23.83, 220/23.86; 62/457.1, 457.4, 457.5, 457.7, 458; 224/273, 275

[56] References Cited

U.S. PATENT DOCUMENTS

| | | | |
|---|---|---|---|
| 3,610,409 | 10/1971 | Graf | 206/4 |
| 3,640,380 | 2/1972 | Huffman | 206/4 |
| 3,648,830 | 3/1972 | Graf | 206/4 |
| 3,667,646 | 6/1972 | Graf | 206/4 X |
| 3,675,814 | 7/1972 | Graf | 206/4 X |
| 3,804,233 | 4/1974 | Gregg, Jr. | 224/273 |
| 4,146,159 | 3/1979 | Hemmen | 224/275 |
| 4,162,029 | 7/1979 | Gottsegen | 220/23.83 X |
| 4,571,740 | 2/1986 | Kirby et al. | 220/23.83 X |
| 4,640,392 | 2/1987 | Decker, Jr. et al. | 220/23.83 X |
| 4,700,395 | 10/1987 | Long | 381/90 |
| 4,747,490 | 5/1988 | Smith | 206/542 |
| 4,757,928 | 7/1988 | Browne | 224/275 |
| 4,765,583 | 8/1988 | Tenner | 224/275 X |
| 4,858,444 | 8/1989 | Scott | 62/372 |
| 4,989,767 | 2/1991 | Buschbom | 224/273 X |

*Primary Examiner*—Steven M. Pollard
*Attorney, Agent, or Firm*—Denton L. Anderson

[57] ABSTRACT

A beverage container holder for attachment to a food and beverage container having a sloped outer surface comprises: (a) an upwardly facing top surface; (b) first and second openings in the top surface forming receptacles for receiving a beverage container; (c) a bottom portion connected to and extending downwardly from the top surface; and (d) an attachment mechanism attached to the bottom portion for further attachment to the sloped outer surface of the carrier. The bottom portion further has an attaching surface which is sloped so that when the container holder is attached to the carrier, the receptacles can receive the beverage container so that the liquid inside the container is level. The disclosed holder also has a third receptacle between the first and second receptacles for receiving miscellaneous small items.

20 Claims, 2 Drawing Sheets

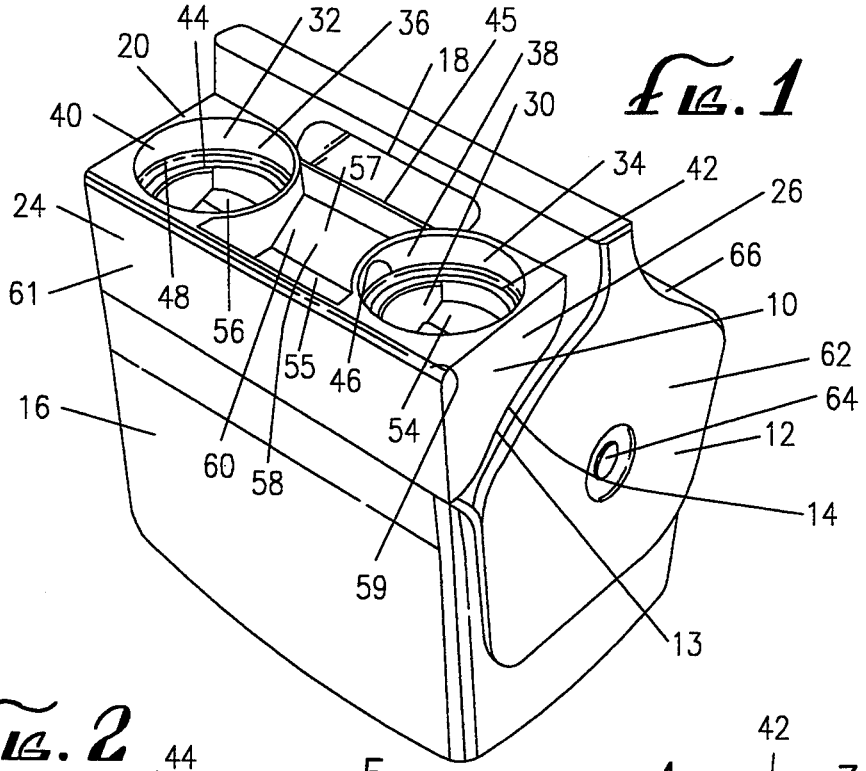
FIG. 1
FIG. 2
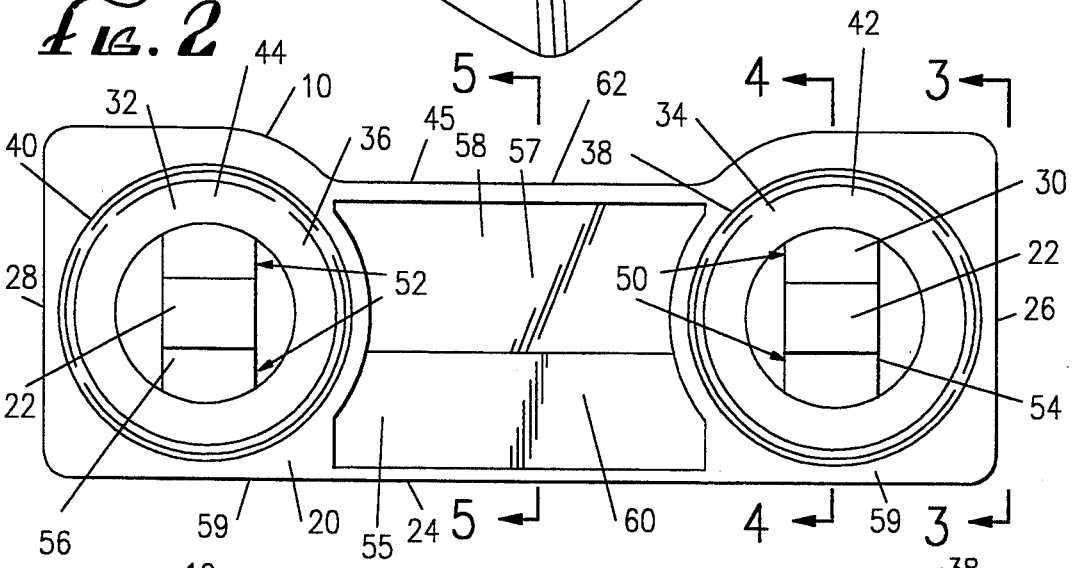
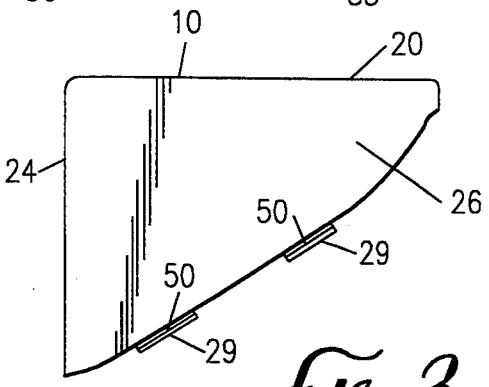
FIG. 3
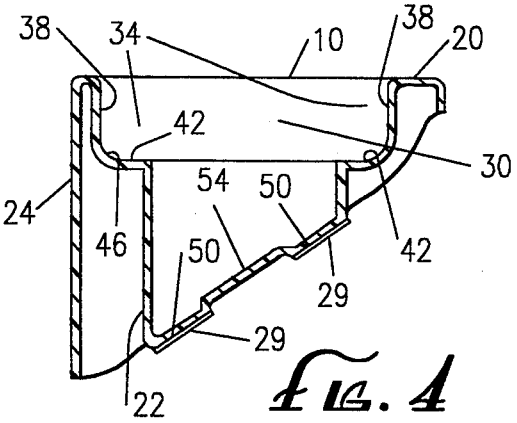
FIG. 4

FIG. 5
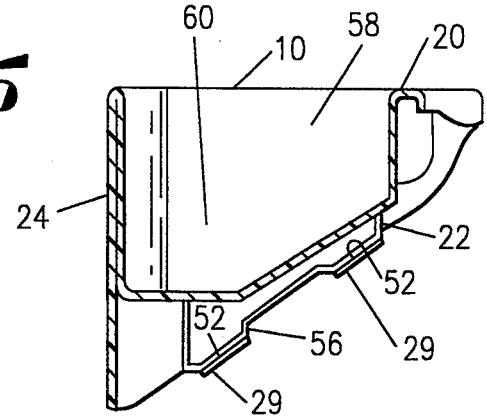
FIG. 6
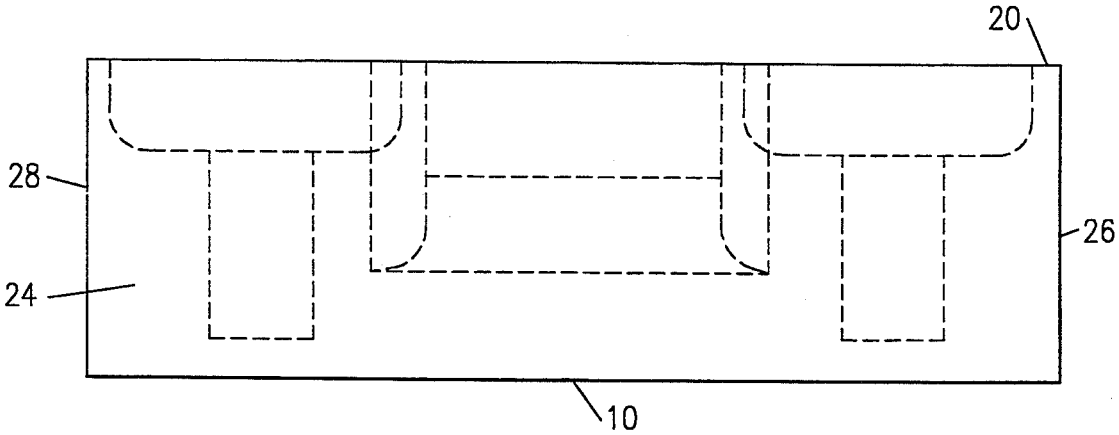
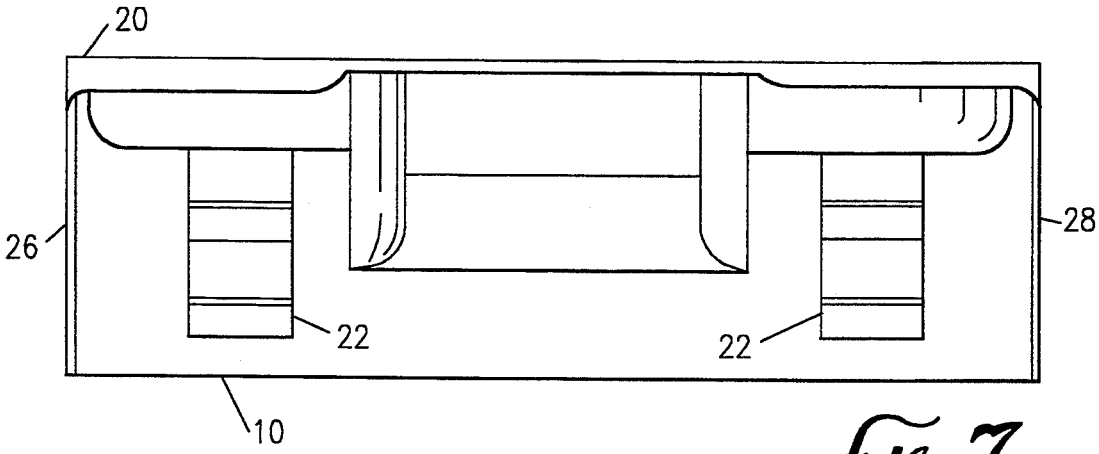
FIG. 7

BEVERAGE CONTAINER HOLDER

BACKGROUND

The present invention relates to devices for holding beverage containers.

When people leave home to engage in recreational activities, such as at the park or the beach, they usually take food and beverages along with them. The food and beverages are often stored in portable food and beverage carriers, such as ice chests. A very popular type of portable carrier has sloped outer surfaces, such as carriers sold under the name PLAYMATE and the trademark IGLOO JUGS ® by Stalnaker Plastics located at 3102 Kiowa Street, Fort Worth, Tex.

The sloped outer surfaces of such carriers, however, are not convenient for placement of a beverage container while beverage is being consumed. A separate item, such as a tray or small table, can be brought along for such a purpose but such an item is often inconvenient to store while traveling. Such an item is difficult to keep level on uneven ground or sand and does not generally provide a secure place for food or drink if the item is moved even slightly from a level position. This is especially true for beverage containers which can easily become slippery due to moisture condensation on their outer surfaces. In addition, such an item for placement of beverage containers is usually not inexpensive and can be easily misplaced.

For the foregoing reasons, there is a need for a beverage container holder which:

(1) Will attach securely to a food and beverage carrier with a sloped outer surface;

(2) Provides a secure and substantially level, nonsliding surface to securely place a beverage container and/or other items;

(3) Is inexpensive to manufacture;

(4) Does not present a storage problem;

(5) Is lightweight; and (6) Is easy to clean.

SUMMARY

The present invention is directed to a beverage container holder that satisfies the foregoing needs.

A beverage container holder according to the present invention can be attached to a carrier having a sloped outer surface. A beverage container holder having features of the present invention can comprise an upward-facing top surface, a first opening in the top surface which forms a first receptacle, and a bottom portion connected to and extending downwardly from the top surface. The bottom portion includes a supporting surface for supporting the container holder on the carrier. The receptacle is for receiving a beverage container.

The container holder can also have an attaching mechanism for attaching the bottom portion of the container holder to the sloped outer surface of the carrier. The attaching mechanism can be attached to the container holder and can later be attached to the carrier when the container holder is installed.

The supporting surface is sloped so that when the container holder is attached to the carrier, the first receptacle can receive the beverage container in a substantially vertical position. This allows the liquid inside the beverage container to remain substantially level.

The receptacle can be formed from a container wall extending downwardly and a seat wall extending laterally and inwardly from the container wall.

The beverage container holder can have a second opening in the top surface similar to the first opening. The first opening and second openings can be spaced apart from the handle so that when the container holder is attached to the carrier, the user can grip a handle on the carrier without touching beverage containers in the first and second receptacles. The beverage container holder can also include a third opening in the top surface which forms a third receptacle for receiving miscellaneous small items, such as keys, sunglasses, cigarettes, chips and other dry food items.

The beverage container holder can also be molded into a sloped outer wall of the carrier.

DRAWINGS

These and other features, aspects, and advantages to the present invention will become understood with regard to the following description, appending claims and accompanying drawings where:

FIG. 1 is a perspective view of a beverage container holder and food and beverage carrier having features of the present invention;

FIG. 2 is a top view of a beverage container holder separate from the carrier having features of the present invention;

FIG. 3 is a side view of the beverage container holder of FIG. 2 taken along line 3—3 of FIG. 2;

FIG. 4 is a cross-sectional view of the beverage container holder of FIG. 2 taken along line 4—4 of FIG. 1;

FIG. 5 is a cross-sectional view of the beverage container holder of FIG. 2 taken along line 5—5 of FIG. 2;

FIG. 6 is a front view of the beverage container holder of FIG. 2 showing elements inside the beverage container holder in phantom; and FIG. 7 is a rear view of the beverage container holder of FIG. 2.

DESCRIPTION

As is shown in FIGS. 1 through 7, a beverage container holder 10 can be attached to a food and beverage carrier 12. The food and beverage carrier 12 has a sloped wall 13, a sloped outer surface 14 on the sloped wall 13, a vertical outer surface 16, a handle 18 and a hollow chamber inside the carrier 12. The carrier 12 shown in FIG. 1 is a cooler box or ice chest for containing and carrying food and beverages. However, the beverage and container holder 10 can be attached to any carrier or similar item having a sloped surface. The beverage container holder 10 in FIG. 1 can be separate from the carrier 12 or can be molded into the sloped wall 13 as part of the carrier 12.

The beverage container holder 10 can comprise a top surface 20, a bottom portion 22, a front wall 24, first and second side walls 26 and 28, respectively, and an attaching mechanism 29. The beverage container holder 10 also has a first opening 30 and a second opening 32 in the top surface 20. The first opening 30 forms a first receptacle 34 for receiving a beverage container, such as a cup or soda can. The second opening 32 similarly forms a second receptacle 36 for receiving a beverage container. The bottom portion 22 and attaching mechanism 29 need not be present when the holder 10 is molded as part of the carrier 12.

The first and second receptacles 34 and 36 have first and second container walls 38 and 40, respectively, and first and second seat walls 42 and 44, respectively. Each of the container walls 38 and 40 extend downwardly from and are substantially perpendicular to the top surface 20. Each of the seat walls 42 and 44 extend inwardly from and substantially perpendicular to first and second lower edges 46 and 48, respectively, of the first and second container walls 38 and 40, respectively. The first and second seat walls 42 and 44 can each support a beverage container. The holder 10 need not have the first and second seat walls to function effectively. The holder 10 can be configured so that the beverage container can rest in either of the first or second receptacles 34 or 36 and be held in place by the first or second container walls 38 and 40, respectively, without the first or second seat walls 42 or 44, respectively. The bottom of the beverage container could then rest against a portion of the bottom portion 22 or even the sloped surface 14.

The first opening 30 is spaced apart from the second opening 32 so that when the beverage container holder 10 is attached to the carrier 12, a user can grip the handle 18 without touching beverage containers received in the first and second receptacles 34 and 36. The carrier 12 can therefore be easily carried by the handle 18 even when beverage containers are in the receptacles 34 and 36. The container holder can have more than the two receptacles 34 and 36 shown in the drawings. For instance, one or two receptacles could fit between the receptacles 34 and 36, especially when the container holder is installed on a carrier which is larger than carrier 12. A larger carrier would leave more room to grip a handle such as the handle 18.

The container holder 10 comprises an inset portion 45 which provides additional room for the hand of the user of the carrier 12. The insert 45 is tapered at both ends to avoid a sharp corner that might cut the hand of the user and to allow the inset 45 to fit different sizes and shapes of handles 18.

The bottom portion 22 connects to and extends downwardly from the top surface 20. The bottom portion 22 includes first and second supporting surfaces 50 and 52. The supporting surfaces 50 and 52 are sloped to fit the slant of the sloped outer surface 14 so that when the container holder 10 is attached to the carrier 12, the receptacles 34 and 36 can receive beverage containers in a substantially vertical position. This way the liquid in the beverage containers remains level when the carrier 12 is carried or set on a relatively flat surface and does not spill.

The bottom portion 22 includes first and second bridges 54 and 56 extending across opposite sides of the seat walls 42 and 44, respectively. The first and second supporting surfaces 50 and 52 are formed underneath the first and second bridges 54 and 56, respectively. The supporting surfaces 50 and 52 could be located on another part of the bottom portion 22, such as at the bottom surface of the first and second side walls 26 and 28. The attaching mechanism 29 can also be located on another part of the holder 10, such as adjacent the top surface 20 and attached to the handle 18 when the holder 10 is installed on the carrier 12.

The attaching mechanism 29 can be attached to the first and second supporting surfaces 50 and 52. The side of the attaching mechanism 29 opposite that attached to the supporting surface 50 or 52 can be attached to the sloped outer surface 14 of the carrier 12. When this happens, the bottom portion 22 of the beverage container holder 10 is attached to the carrier 12.

The attaching mechanism 29 can be foam tape which is sticky on both sides so the tape can be attached securely to each of the supporting surfaces 50 and 52, as well as the sloped outer surface 14. A suitable double stick foam tape is designated 4929-Y and is made by Minnesota Mining and Manufacturing Company located in St. Paul, Minn. A variety of other means can be used for the attaching mechanism 29, such as glue or the woven hook and loop fasteners sold under the registered trademark VELCRO® by Velcro U.S.A. Inc. located in Manchester, N.H.

The beverage container holder 10 further comprises a third opening 58 in the top surface 20. The third opening 58 forms a third receptacle 60 for receiving small items, such as keys, sunglasses, cigarettes, chips and other dry food items. The third opening 58 is located between the first and second openings 30 and 32 and is adjacent to the handle 18 when the holder 10 is attached to the carrier 12. The third receptacle 60 has first and second slanted surfaces 55 and 57, respectively, which meet in the middle of the third receptacle 60. However, the third receptacle 60 can have a flat bottom surface and the third receptacle can extend all the way across the container holder 10 replacing the first and second receptacles 34 and 36.

The front wall 24 of the holder 10 is connected to and substantially perpendicular with a forward portion 59 of the top surface 20. The front wall 24 can form a front surface 61 substantially flush with the vertical surface 16, as shown in FIG. 1. However, it is not necessary that the front surface 61 be flush with the vertical surface 16 depending on the size of the carrier 12 and its sloped outer surface 14. When the carrier 12 is larger than that shown in the drawings, the beverage container holder 10 can be installed on the sloped outer surface 14 away from the vertical outer surface 16 so that it fits with the handle 18. Alternatively, the beverage container holder 10 can be installed spaced apart from the handle 18. The holder 10 can also be installed away from the handle 18 and flush with the vertical outer surface 16.

The front surface 61, as shown in FIG. 1, is substantially flat and smooth. The front surface 61 can therefore be used to place a sticker or stickers which advertise products or services as desired. Alternatively, the advertising can be molding in or painted on the front surface 61 of the holder 10. This kind of advertising can be inexpensive and very effective because the user of the holder 10 and carrier will typically expose the advertisements to a variety of persons, such as those at the beach or park.

The drawings illustrate a beverage container holder 10 on only one side of the carrier 12. However, a container holder 10 can be installed on each of the sloped sides of the carrier 12, thereby allowing four (or more) beverage containers to be received by the beverage container holders.

Installation and use of the beverage container holder 10 is simple and easy. The beverage container holder 10 can come with the attaching mechanism 29 already attached to the first and second supporting surfaces 50 and 52. If double stick foam tape is used for the attaching mechanism 29, release paper can be provided on the bottom side of the attaching mechanism 29. The release paper can be removed and the front wall 24 of the container holder 10 lined up flush with the vertical outer surface 16 of the carrier 12. The holder 10 can then be pressed into place on the sloped outer surface 14.

The holder 10 is used by placing beverage containers as desired into the receptacles 34 and 36 after the holder 10 is installed on the carrier 12. The third receptacle 60 can be used by placing small items therein as desired.

The carrier 12 illustrated in the drawings is hinged in the middle of a top lid 62. A hinge button 64 releases the top lid 62 so it can be rotated open. The top lid 62 pivots open to provide access to the hollow chamber inside the carrier 12. The container holder 10 can be installed on either the sloped surface 14 or on the other sloped surface 66 of the carrier 12 on the opposite side of the handle 18 from the sloped surface 14.

The holder 10 can be made of hard plastic, such as high impact polystyrene, which can be injection molded at low cost. The holder 10 can also be made of other materials such as polyurethane foam, molded cardboard, soft metal such as aluminum or the material sold under the registered trademark STYROFOAM® made by Dow Chemical Corporation of Midland, Mich. When the STYROFOAM® material is used, the container holder 10 need not be hollow underneath as shown in the drawings and need not have the first and second bridges 54 and 56. The container holder can be completely filled in with STYROFOAM® material beneath the first and second receptacles 34 and 36.

When the beverage container holder 10 is installed, the holder 10 can be left permanently in place on the carrier 12. Therefore, the beverage container holder 10 does not need to be separately stored and is not easily misplaced separately from the carrier 12. The holder 10 is small and does not add significant weight to the carrier 12.

The holder 10 is very easy to clean, especially when it is made of plastic. It can be sprayed clean or wiped with a damp sponge without retaining much moisture inside. The moisture that remains can be allowed to evaporate because there is substantial ventilation in the holder 10 even when it is installed on the carrier 12, as shown in FIG. 1.

The manufacturing specifications and tolerances need not be precise for the holder 10. The most stringent specifications that are required are those of the first and second receptacles 34 and 36, depending on how close the fit for a particular type of beverage container is desired.

The beverage container holder 10 can be made to fit on a carrier 12, such as the ice chests sold in "mini," "little" and "regular" sizes under the name PLAYMATE and the registered trademark IGLOO JUGS® by Stalnaker Plastics located at 3102 Kiowa Street, Forth Worth, Tex. The dimensions for the beverage container holder 10 that would fit on each of the foregoing ice chests, including the smallest "mini" ice chest, could have a length about 6 to 8.5 inches and a width of about 2.8 to 3.125 inches. The height of the beverage container holder 10 can be about 2.25 to 2.75 inches. A suitable depth of the first and second receptacles 34 and 36 between the top surface 20 and the seat walls 42 and 44 could be about 0.5 to 0.7 inches. A suitable clearance between the container walls 38 and 40 and a typical beverage container, such as a soda can, could be about 0.03 to about 0.07 inches. When the beverage container holder 10 is made of high impact polystyrene, a suitable thickness for the various walls in the container holder 10 could range from about 0.04 inch to about 0.1 inch. The supporting surfaces 50 and 52 can extend below the bottom edges of the side walls 26 and 28 by about 0.02 inch to 0.06 inch. Of course, all of the foregoing dimensions could vary greatly depending on the size of the carrier 12 and the desired fit of the container holder 10 with the carrier 12.

Although the present invention has been described in considerable detail with reference to certain preferred versions thereof, other versions are possible. Therefore, the spirit and scope of the appended claims should not be limited to the description of the preferred versions contained herein.

What is claimed is:

1. A beverage container holder for attachment to a carrier having a sloped outer face and a handle above the sloped outer surface for gripping by a user of the carrier, the container holder comprising:

(a) a top surface facing upwardly;

(b) a first opening in the top surface, the first opening forming a first receptacle for receiving a beverage container;

(c) a second opening in the top surface, the second opening forming a second receptacle for receiving the beverage container;

(d) a bottom portion connected to and extending below the top surface, the bottom portion including first and second supporting surfaces;

(e) an attaching mechanism connected to and adjacent with the first and second supporting surfaces for attaching the bottom portion to the sloped outer surface;

the first and second supporting surfaces being sloped so that when the bottom portion is attached by the attaching mechanism to the sloped outer surface, the first and second receptacles each being capable of receiving the beverage container in a substantially vertical position wherein liquid in the beverage container is substantially level.

2. The beverage container holder of claim 1 wherein the first opening is spaced apart from the second opening so that the user can grip the handle without touching beverage containers received in the first and second receptacles.

3. The beverage container holder of claim 1 wherein:

(i) the first receptacle has: (A) a first container wall extending downwardly from and substantially perpendicular to the top surface; and (B) a first seat wall for supporting the beverage container, the first seat wall extending laterally and inwardly from a first lower edge of the first container wall; and (ii) the second receptacle has: (A) a second container wall extending downwardly from and substantially perpendicular to the top surface; and (B) a second seat wall for supporting the beverage container, the second seat wall extending laterally and inwardly from a second lower edge of the second container wall.

4. The beverage container holder of claim 1 further comprising a third opening in the top surface between the first and second openings, the third opening forming a third receptacle for receiving small items.

5. A beverage container holder for attachment to a carrier having a sloped outer surface and a handle adjacent to and above the sloped outer surface for gripping by a user of the carrier, the container holder comprising:

(a) a first receptacle for receiving a beverage container, the first receptacle having a first container wall extending downwardly and sized to receive the beverage container;

(b) a bottom portion connected to and extending below the first receptacle, the bottom portion including first and second supporting surfaces;

(c) an attaching mechanism adjacent to the supporting surface for attaching the bottom portion to the sloped outer surface;

the supporting surfaces being sloped so that when the bottom portion is attached by the attaching mechanism to the sloped outer surface, the first receptacle is capable of receiving the beverage container in a substantially vertical position wherein liquid inside the beverage container is substantially level, the first receptacle being spaced apart from the handle so that the user can grip the handle without touching the beverage container received in the first receptacle.

6. The beverage container holder of claim 5 wherein the first receptacle further comprises a first seat wall for supporting the beverage container, the first seat wall extending laterally and inwardly from a first lower edge of the first container wall.

7. The beverage container holder of claim 6 further comprising a second receptacle for receiving a beverage container, the second receptacle having: (i) a second container wall extending downwardly and sized to receive the beverage container; and (ii) a second seat wall for supporting the beverage container, the second seat wall extending laterally and inwardly from a second lower edge of the second container wall.

8. A beverage container holder for attachment to a carrier having a sloped outer surface and a handle above the sloped outer surface for gripping by a user of the carrier, the beverage container holder comprising:

(a) a top surface facing upwardly;

(b) a first opening in the top surface, the first opening forming a first receptacle for receiving a beverage container, the first receptacle having:

(i) a first container wall extending downwardly from and substantially perpendicular to the top surface; and (ii) a first seat wall for supporting the beverage container, the first seat wall extending laterally and inwardly from a first lower edge of the first container wall;

(c) a second opening in the top surface, the second opening forming a second receptacle for receiving the beverage container, the second receptacle having:

(i) a second container wall extending downwardly from and substantially perpendicular to the top surface; and (ii) a second seat wall for supporting the beverage container, the second seat wall extending laterally and inwardly from a second lower edge of the second container wall;

(d) a third opening in the top surface between the first and second openings, the third opening forming a third receptacle for receiving small items;

(e) a bottom portion connected to and extending downwardly from the top surface, the bottom portion including first and second supporting surfaces below the top surface; and (f) a front wall connected to and substantially perpendicular with a forward portion of the top surface;

(g) an attaching mechanism connected to and adjacent with the first and second supporting surfaces for attaching the bottom portion to the sloped outer surface;

the first and second supporting surfaces being sloped so that when the bottom portion is attached by the attaching mechanism to the sloped outer surface, the first and second receptacles are each capable of receiving the beverage container in a substantially vertical position wherein liquid in the beverage container is substantially level.

9. The beverage container holder of claim 8 wherein the bottom portion further has (i) a first bridge extending across opposite sides of the first seat wall, the first supporting surface being formed underneath the first bridge; and (ii) a second bridge across opposite sides of the second seat wall, the second supporting surface being formed underneath the second bridge.

10. A beverage container holder and carrier comprising:

(a) a handle for gripping by a user of the carrier;

(b) a sloped wall adjacent the handle;

(c) a hollow chamber inside the carrier; and (d) a beverage container holder in the sloped wall, the container holder comprising a first receptacle in the sloped wall for receiving a beverage container so that liquid in the container is substantially level when the container is received by the first receptacle, the first receptacle having: (i) a first container wall extending downwardly and sized to receive the beverage container; and (ii) a first seat wall for supporting the beverage container, the first seat wall extending laterally and inwardly from a first lower edge of the first container wall.

11. The beverage container holder and carrier of claim 10 wherein the beverage container holder further comprises a second receptacle in the sloped wall for receiving the beverage container so that liquid in the container is substantially level when the container is received by the second receptacle, the second receptacle having: (i) a second container wall extending downwardly and sized to receive the beverage container; and (ii) a second seat wall for supporting the beverage container, the second seat wall extending laterally and inwardly from a second lower edge of the second container wall, the first and second receptacles being spaced apart from the handle so that the user can grip the handle without touching beverage containers received in the first and second receptacles.

12. The carrier of claim 11 further comprising a third receptacle between the first and second receptacles for receiving small items.

13. A beverage container holder for attachment to a carrier having a sloped outer surface and a handle adjacent to and above the sloped outer surface for gripping by a user of the carrier, the container holder comprising:

(a) a top surface facing upwardly;

(b) a first opening in the top surface, the first opening forming a first receptacle for receiving a beverage container;

(c) a second opening in the top surface, the second opening forming a second receptacle for receiving the beverage container;

(d) a bottom portion connected to and extending below the top surface, the bottom portion including a supporting surface for supporting the beverage container holder on the carrier; and (e) an attaching mechanism for attaching the beverage container holder to the carrier;

the supporting surface being sloped so that when the beverage container holder is attached to the carrier, the first receptacle is capable of receiving the beverage container in a substantially vertical position wherein liquid inside the beverage container is substantially level, the first opening being spaced apart from the second opening in the top surface so that when the container holder is attached to the carrier, the user can grip the handle without touching the beverage container received in the first or second receptacle.

14. The beverage container holder of claim 13 further comprising a third opening in the top surface between the first and second openings, the third opening forming a third receptacle for receiving small items.

15. The beverage container holder of claim 13 further comprising a front surface adjacent to and substantially perpendicular with a forward portion of the top surface, the front surface being substantially flat for receiving advertising messages.

16. The beverage container holder of claim 13 wherein the attaching mechanism comprises foam tape sticky on both sides.

17. A carrier comprising:

(a) a sloped outer surface;

(b) a handle adjacent to and above the sloped outer surface for gripping by a user of the carrier;

(c) a container holder attached to the sloped outer surface, the container holder comprising:

(i) a top surface facing upwardly;

(ii) a first opening in the top surface, the first opening forming a first receptacle for receiving a beverage container;

(iii) a bottom portion connected to and extending below the top surface, the bottom portion including a supporting surface for supporting the beverage container holder on the sloped outer surface; and (iv) an attaching mechanism for attaching the beverage container to the sloped outer surface;

the supporting surface being sloped so that when the beverage container holder is attached to the sloped outer surface, the first receptacle is capable of receiving the beverage container in a substantially vertical position wherein the liquid inside the beverage container is substantially level, the first opening being spaced apart from the handle so that the user can grip the handle without touching the beverage container received in the first receptacle.

18. The carrier of claim 17 wherein the beverage container holder further comprises a second opening and top surface, the second opening forming a second receptacle for receiving the beverage container, the second receptacle being spaced apart from the handle so that when the beverage container is received in the second receptacle, the user can grip the handle without touching the beverage container.

19. The carrier of claim 18 further comprising a third opening in the top surface between the first and second openings, the third opening forming a third receptacle for receiving small items.

20. The carrier of claim 17 wherein the attaching mechanism comprises foam tape sticky on both sides.

* * * * *